US009877553B2

(12) United States Patent
Zimmerman

(10) Patent No.: US 9,877,553 B2
(45) Date of Patent: Jan. 30, 2018

(54) AUTO-ILLUMINATING WALKING ASSISTANT

(71) Applicant: James D. Zimmerman, Harrisburg, PA (US)

(72) Inventor: James D. Zimmerman, Harrisburg, PA (US)

( * ) Notice: Subject to any disclaimer, the term of this patent is extended or adjusted under 35 U.S.C. 154(b) by 186 days.

(21) Appl. No.: 14/101,481

(22) Filed: Dec. 10, 2013

(65) Prior Publication Data

US 2014/0192516 A1 Jul. 10, 2014

Related U.S. Application Data

(60) Provisional application No. 61/750,657, filed on Jan. 9, 2013.

(51) Int. Cl.
*H02J 17/00* (2006.01)
*A45B 3/04* (2006.01)

(52) U.S. Cl.
CPC ..... *A45B 3/04* (2013.01)

(58) Field of Classification Search
CPC ..... A45B 3/00; A45B 3/04; A45B 2009/002; A45B 2200/1027; A45B 3/02; A45B 3/08; A45B 9/02; Y10S 135/91; F21S 9/03
USPC ..... 135/65
See application file for complete search history.

(56) References Cited

U.S. PATENT DOCUMENTS

| | | | | |
|---|---|---|---|---|
| 4,062,371 | A * | 12/1977 | Bolen | 135/66 |
| 5,219,402 | A * | 6/1993 | Kondo | A45B 3/00 135/66 |
| 5,331,990 | A * | 7/1994 | Hall | A45B 3/00 135/65 |
| 6,145,993 | A * | 11/2000 | Filippino | A45B 3/04 362/102 |
| 6,745,786 | B1 * | 6/2004 | Davis | 135/65 |
| 9,044,374 | B1 * | 6/2015 | Stimpson | A61H 3/061 |
| 2005/0257818 | A1 * | 11/2005 | Gillebaard | 135/72 |
| 2009/0223546 | A1 * | 9/2009 | Nazarian | 135/66 |

FOREIGN PATENT DOCUMENTS

| | | | | |
|---|---|---|---|---|
| GB | 2404144 A * | 1/2005 | | A45B 3/04 |

* cited by examiner

*Primary Examiner* — Tracie Y Green
(74) *Attorney, Agent, or Firm* — Global Intellectual Property Agency, LLC; Jordan Sworen

(57) ABSTRACT

A walking cane is provided having an elongated length, a handle grip, a forward-directed illumination source, and an ambient light sensor. The device provides a cane-user with forward illumination during twilight and dark periods, whereby the ambient light sensor operably energizes the light source when in an appropriate operational mode. A secondary mode allows the user to manually operate or deactivate the light source by hand controls, wherein each option is selectable from a three-way switch at the base of the handle grip. The length of the cane may be adjustable and its structure may take on an ergonomic shape, while the lower distal end is capped with a cane ferrule.

5 Claims, 3 Drawing Sheets

AUTO-ILLUMINATING WALKING ASSISTANT

CROSS REFERENCE TO RELATED APPLICATION

This application claims the benefit of U.S. Provisional Application No. 61/750,657 filed on Jan. 9, 2013, entitled "LED Walking Cane." The above identified patent application is herein incorporated by reference in its entirety to provide continuity of disclosure.

BACKGROUND OF THE INVENTION

Field of the Invention

The present invention relates to walking assistants and cane supports. More specifically, the present invention pertains to a new and novel illuminated walking cane that provides forward illumination for a walking user when the ambient light dims below a given threshold.

Canes are well known walking assistants in the art, and generally include an elongated shaft, a handle end, and a distal end that is pressed against the ground to momentarily support a walking user between strides. These devices are greatly useful for the elderly, the injured, and the partially disabled, where balance is more easily achieved and the user can rest his or her weight on the cane during temporary periods of rest. Overall, the device provides a useful mobility tool that assists many individuals navigating their way to a destination without mishap and with improved balance.

A common issue arises when using a cane in dimly lit environments and during twilight periods. Since the user's one hand is occupied by holding the cane, the use of a separate lighting tool is not always convenient or even possible. This makes walking more treacherous, as the user is unable to see clearly in front of himself and may walk on uneven ground or place weight on the cane when positioned on an uneven or unsure landing area. This is common when walking outdoors in the early evening and night periods, but is also a common problem indoors walking from room to room or when indoor light is not available or accessible.

The present invention pertains to an illuminating walking cane assistant that also provides an ambient light sensor for automatic operation, whereby the device energizes a light source when the environment dims below a given threshold. This automatic illumination is helpful when navigating interior spaces that may have non-uniform lighting between rooms or in closed spaces, and is also useful when walking outdoors. The device includes a light emitting diode (LED) or similar light source, a power source, and a cane structure that is supportive of a walking user. Overall, the device is intended to add a layer of safety to an existing walking assistant, ensuring adequate illumination of a walking path so obstacles and hazards are readily visualized therealong.

Description of the Prior Art

Devices have been disclosed in the prior art that relate to lighted canes and lighted walking assistants. These include devices that have been patented and published in patent publications, and generally relate to various cane structures having an internal light source for improved forward clarity for a walking user. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,394,116 to Winn discloses an illuminated walking cane that comprises an elongated shaft having an operably illuminated ground tip. The ground tip includes a clear section and a frosted section through which a light emitting member shines light through. The clear portion directs a bright point of the light while the frosted region diffuses the light, whereby the entire assembly provides for improved illumination of the ground area near the cane for visualization of the ground and recognition of the walking user. The present invention provides a walking cane having a handle member for illuminating the immediate area in front of a user, whereby the light source can be automatically regulated by an ambient light sensor for reduced vigilance over the light source and ensured operation in low light.

Similarly, U.S. Pat. No. 5,582,196 to Hae discloses a multipurpose cane assembly that comprises a hollow handle providing both storage and a means to support a light source therein. A power source, a lamp, a circuit board, and a switch are supported by the handle, wherefrom the light source projects light from the front of the handle for improved clarity while walking. A secondary storage compartment within the handle provides a means to support personal accessory items. The Hae device comprises a multi-function cane handle for both storage and for illumination purposes. Its elements, while providing a unique cane accessory, fail to disclose the novel features of the present invention.

U.S. Patent Publication No. 2008/0251109 to Lee discloses yet another lighting device for a walking stick, wherein the device comprises one that includes a lighting unit, a power supply, a manual power input, and an alerting unit for providing a sound alert or visual alert to others. The device stores electrical power by way of a battery pack, while a hand crank is provided for charging the battery. The alerting means also provides improved functionality over other illuminated walking canes. However, the Lee device fails to disclose the illuminated walking cane of the present invention and its automatic operation in dim light environments. The Lee device is primarily related to a walking cane having improved illumination characteristics for others to take notice.

Finally, U.S. Patent Publication No. 2012/0223645 to Lu discloses an illuminating device for use with a walking stick, wherein the device is attached to the base of the walking stick and provides illumination therefrom. The walking stick is accepted into a main body, while a power supply provides electrical power to a light source. The light is emitted through a light shade to provide an illuminating effect. Similar to the Winn device, the Lu device fails to disclose the novel features of the present cane handle.

The present invention provides a new and novel walking cane device that provides a means of automatically energizing in low light environments. This makes the use of the cane in dynamic environments safer for the user, where the user may be entering darker regions of an interior space or may be passing through areas of dim light while outdoors. The present invention provides an ambient light sensor that can gauge the outdoor lighting environment and operably energize a light source within the cane handle, illuminating the immediate area in front of the user for ensured footing and placement of the cane while walking.

It is submitted that the present invention is substantially divergent in design elements from the prior art, and consequently it is clear that there is a need in the art for an improvement to existing illuminated walking cane devices. In this regard the instant invention substantially fulfills these needs.

SUMMARY OF THE INVENTION

In view of the foregoing disadvantages inherent in the known types of walking canes now present in the prior art, the present invention provides a new walking cane device that can be utilized for providing convenience for the user when walking in dimly lit environments or those with areas of inadequate and non-uniform lighting.

It is therefore an object of the present invention to provide a new and improved illuminated walking cane device that has all of the advantages of the prior art and none of the disadvantages.

It is another object of the present invention to provide an illuminated walking cane device that is capable of responding to changes in the ambient environment by operably energizing a light source when necessary for user safety.

Another object of the present invention is to provide an illuminated walking cane device that can provide constant illumination, illumination only in low light, or ceased operation.

Yet another object of the present invention is to provide an illuminated walking cane device that provides a high intensity LED for bright, visually illuminating light immediately in front of the user while walking with the cane.

Another object of the present invention is to provide an illuminated walking cane that improves a cane user's ability to see his or her footing and for others to see the user while walking, while further the device can serve as a light source for locating items in low light environments.

A final object of the present invention is to provide an illuminated walking cane that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
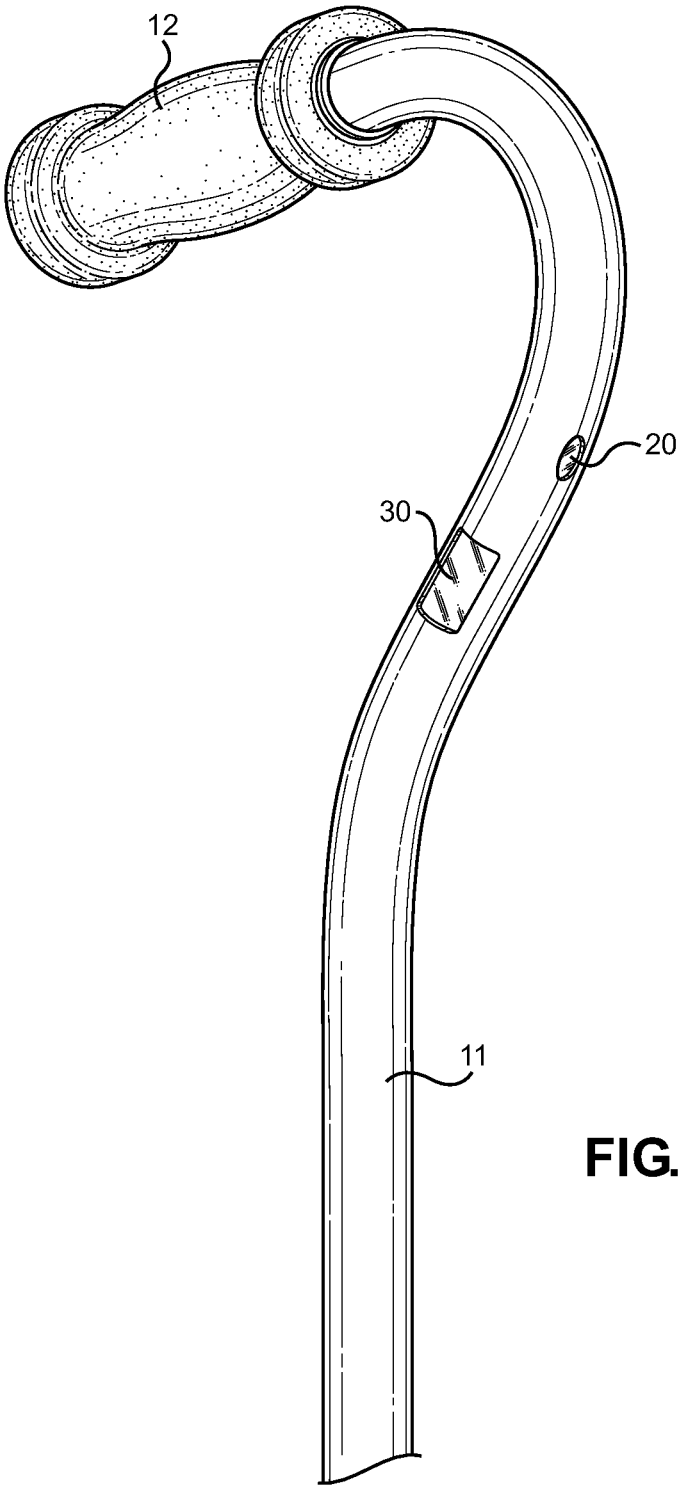
FIG. 1 shows a perspective view of the walking cane handle end.

Reference is made herein to the attached drawings. Like reference numerals are used throughout the drawings to depict like or similar elements of the illuminated walking cane. For the purposes of presenting a brief and clear description of the present invention, the preferred embodiment will be discussed as used for providing a light source in conjunction with a walking cane that can automatically be triggered in low light environments. The figures are intended for representative purposes only and should not be considered to be limiting in any respect.

Referring now to FIG. 1, there is shown a frontal perspective view of the walking cane device of the present invention along its upper, handle end. The walking cane comprises an elongated shaft member 11 having a lower distal end and an upper handle end. The body 11 may include different designs or ergonomic shapes to suit the particular user and his or her ailment, however within the cane along the handle end are several electrical components imbedded therein that provide an automatically energizing light source directed forward for the walking user. The handle grip 12 is preferably at an angle with respect to the length of the cane, as is common with most walking canes, whereby the handle grip 12 provides a means to rest against or easily grasp as the user's arms are at his or her sides.

Along the handle end is a first light source 20 and an ambient light sensor 30. The light source is preferably a light emitting diode (LED) that is energized by a battery stowed within the handle grip 12 of the cane structure. The battery is connected to an electrical circuit that drives the light source 20, receives signals from the ambient light sensor 30, and responds to inputs from the user operation switch at the distal end of the handle grip 12.

Figure 2:
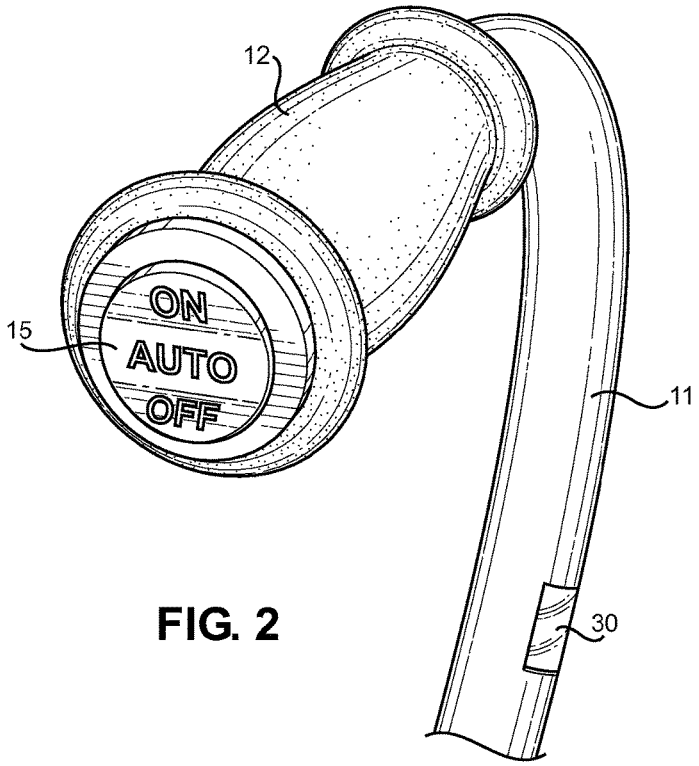
FIG. 2 shows another perspective view of the walking cane handle and the three-way controller for the light source and device operation.

Referring now to FIG. 2, the distal end of the handle grip 12 is visualized, along with the upper, handle end of the cane shaft member 11. At the end of the grip is a three-way switch 15, which allows the user to manually energize the light source ("ON"), manually cease its operation ("OFF"), or place its control in the hands of the electrical circuit and the ambient light sensor 30. This automatic mode ("AUTO"), causes the light source to be energized only when the ambient light sensor 30 detects a level of ambient light below a given threshold, whereby the light source is energized and the user is better able to see the ground in front of the cane.

Figure 3:
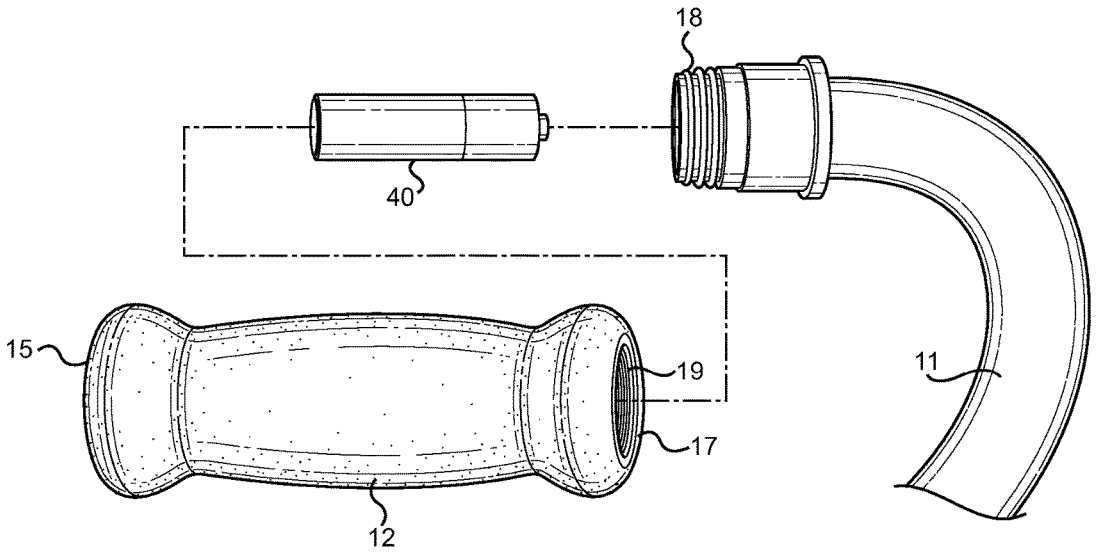
FIG. 3 shows an exploded view of the handle end of the walking cane and the battery power source stored therein.

Referring now to FIG. 3, there is shown an exploded view of the handle grip assembly of the present invention. Within this region is a hollow interior 19 for which to support a battery power supply 40 and provide electrical connectivity between the power source 40, the handle switch 15, and the other interior electrical components that control operation of the device. The handle grip 12 preferably comprises a threaded end 17 that threadably attaches to the threaded end 18 of the cane upper shaft member 11. Therefore, the handle grip 12 is removable to replace the battery after a period of use and when the battery 40 is depleted.

Figure 4:
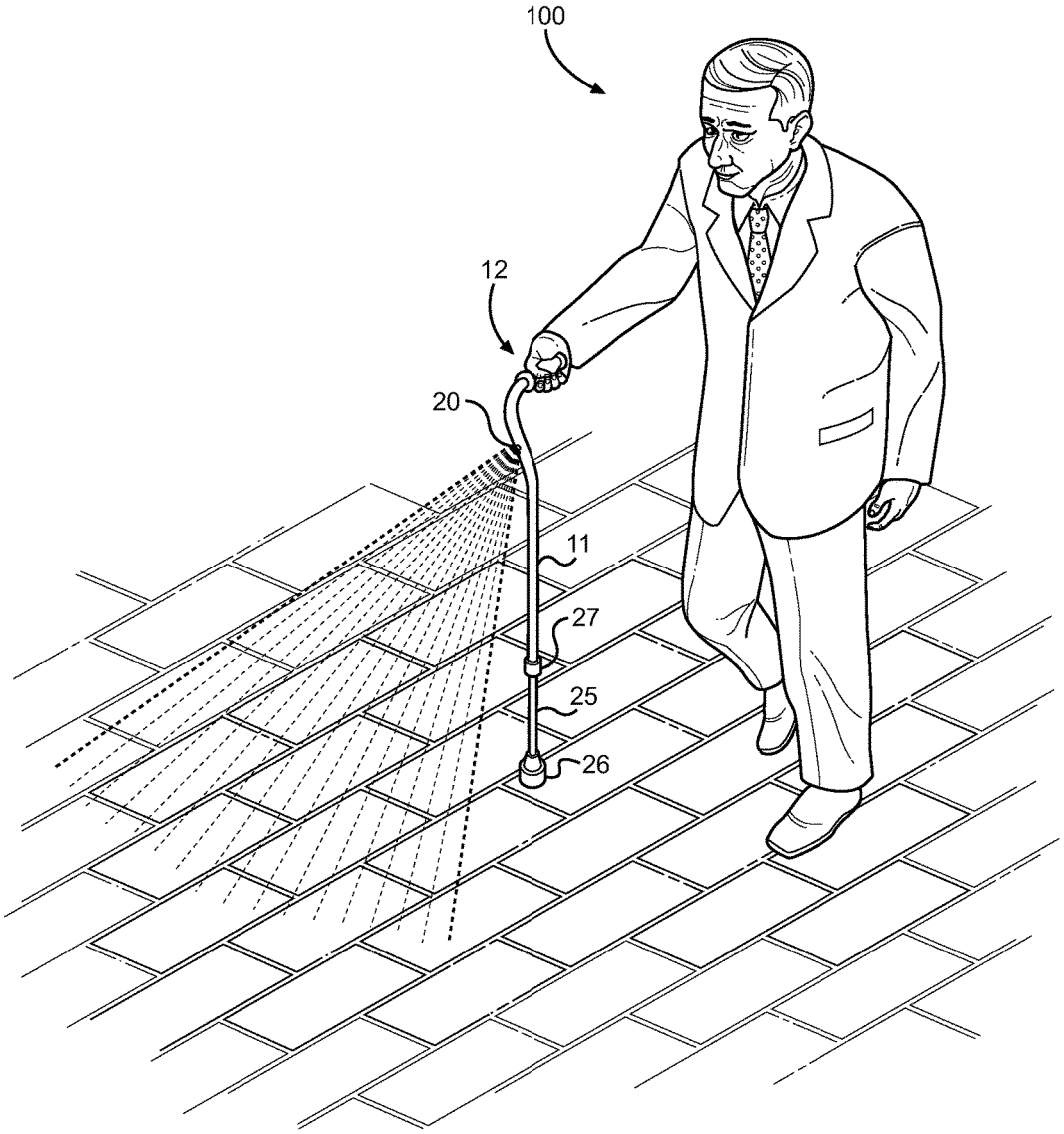
FIG. 4 shows a pictorial view of the embodiment in a working state, providing forward illumination for a walking user.

Referring finally to FIG. 4, there is shown a view of the walking cane device in a working state, illuminating a pathway in front of the user 100 such that he is able to visualize his footing. The cane shaft 11 is utilized as a supportive walking assistant with a handle 12 end and a distal end. The distal end is preferably covered by a cane ferrule for improved grips and wider base support for the device, while the cane shaft member 11 may be telescoping in nature to allow for different heights and have an inherently ergonomic shape. In one embodiment, an inner shaft 25 concentrically secures within the cane shaft member and is securable by way of a locking mechanism 27. This allows the overall length of the cane to be adjustable and statically securable when in operation. However, in its most simple form the cane can be of unitary material and design.

The light source 20 provides a forward-projecting light path for which the user to visualize upcoming terrain and obstacles. Adjacent to the light source but not affected thereby is the ambient light sensor, which operably controls the operation of the light source 20 if the user so desires. The user can further operation the light source 20 manually or cease its operation altogether.

It can be especially difficult for those who require walking assistants to move about in low-light or dark conditions. Moving around in the dark can cause one to trip, fall, bump into objects or experience other hazards. Turning on an overhead light to move around may disturb other residents in a home, while walking outdoors in twilight or at night requires artificial light sources that may not be handy or available in the environment. Similarly, one using a walking assistant may not be able to support a personal light source as easily as one would otherwise.

Therefore, the present invention provides an illuminated walking cane having an automatic operation. The device includes a built-in LED light source, a power source, controls for operation, and a structure that allows for unchanged support for one accustomed to cane walking assistants. The device further includes an ambient light sensor, which can be used for automatically illuminating an area in low-light conditions. The ambient light sensor can also be overridden for battery conservation or for privacy. This provides light for anyone using a cane to walk in dark conditions, eliminates the need to store and transport a separate light for nighttime mobility, and improves the overall safety of assisted walking in dark areas.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An illuminated walking assistant, comprising:

an elongated shaft member having a handle end and a distal end;

said handle end comprising a handle grip, a removable power supply, and an electrical switch;

a light source along said shaft member;

an ambient light sensor along said shaft member;

said power supply, electrical switch, light source, and ambient light sensor in electrical connectivity with one another;

said ambient light sensor adapted to energize said light source when ambient light dims below a given threshold;

said switch further comprising a three-way switch adapted to operably allow for continuous light operation, deactivating said light source, or finally allowing said ambient light sensor to operably determine when to energize said light source.

2. The device of claim 1, wherein said light source further comprises a light emitting diode and associated electrical circuitry.

3. The device of claim 1, wherein said elongated shaft is telescopic and adapted to change lengths and secure in a static working state.

4. The device of claim 1, wherein said elongated shaft member distal end further comprises a cane ferrule.

5. The illuminated walking assistant of claim 1, wherein the switch is disposed at an end of the handle grip.

* * * * *